US008740049B2

(12) United States Patent
Tallier

(10) Patent No.: US 8,740,049 B2
(45) Date of Patent: Jun. 3, 2014

(54) EASY OPENING OF FILM WRAPPER

(75) Inventor: Bernard Tallier, Cortaillod (CH)

(73) Assignee: Philip Morris USA Inc., Richmond, VA (US)

( * ) Notice: Subject to any disclaimer, the term of this patent is extended or adjusted under 35 U.S.C. 154(b) by 1014 days.

(21) Appl. No.: 11/792,139

(22) PCT Filed: Nov. 25, 2005

(86) PCT No.: PCT/EP2005/056231

§ 371 (c)(1), (2), (4) Date: Aug. 14, 2007

(87) PCT Pub. No.: WO2006/058864

PCT Pub. Date: Jun. 8, 2006

(65) Prior Publication Data

US 2008/0135428 A1 Jun. 12, 2008

(30) Foreign Application Priority Data

Dec. 3, 2004 (EP) ..... 04028708

(51) Int. Cl.
*B65D 65/26* (2006.01)
*B65D 85/10* (2006.01)

(52) U.S. Cl.
USPC ..... 229/87.05; 229/87.13

(58) Field of Classification Search
USPC ..... 229/87.05, 87.13, 87.2, 87.09
See application file for complete search history.

(56) References Cited

U.S. PATENT DOCUMENTS

| | | | | | |
|---|---|---|---|---|---|
| 1,324,578 | A | * | 12/1919 | Bard | 221/32 |
| 1,824,948 | A | * | 9/1931 | Fields | 206/264 |
| 1,836,228 | A | * | 12/1931 | Dryer | 206/264 |
| 2,307,667 | A | | 1/1943 | Cornock | |
| 2,582,992 | A | * | 1/1952 | Hergert | 206/361 |
| 3,179,327 | A | * | 4/1965 | Burton et al. | 206/459.5 |
| 4,782,956 | A | | 11/1988 | Yoshizawa et al. | |
| 5,018,625 | A | * | 5/1991 | Focke et al. | 229/87.05 |
| 5,040,685 | A | * | 8/1991 | Focke et al. | 229/87.05 |
| 5,487,503 | A | * | 1/1996 | Sato et al. | 229/87.05 |
| 5,489,060 | A | * | 2/1996 | Godard | 229/87.05 |
| 6,244,435 | B1 | | 6/2001 | Cho | |

FOREIGN PATENT DOCUMENTS

| | | | | | |
|---|---|---|---|---|---|
| DE | 27 30 025 | A1 | * | 1/1979 | 229/87.05 |
| DE | 2730025 | | | 1/1979 | |
| EP | 0376793 | | | 7/1990 | |
| EP | 0644127 | | | 3/1995 | |
| GB | 2212471 | A | * | 7/1989 | B65D 65/26 |
| JP | A 58-023077 | U | | 8/1956 | |
| JP | A 58-094663 | U | | 6/1983 | |
| JP | A 60-038259 | U | | 3/1985 | |
| JP | A 01-078572 | U | | 5/1989 | |

* cited by examiner

*Primary Examiner* — Jes F Pascua

(74) *Attorney, Agent, or Firm* — Buchanan Ingersoll & Rooney PC

(57) ABSTRACT

A film wrapper (99) comprises a tear tape (30) and at least one weakening line (10, 12) next to the tear tape (30), the longitudinal axis of the at least one weakening line (10, 12) being substantially perpendicular to the tear tape (30) (perpendicular weakening lines (10, 12)). An article is wrapped into the film wrapper. A multi-bladed knife (100) used for producing the film wrapper comprises a U-shaped or V-shaped first blade (110) and a second linear blade (112) parallel to the longitudinal axis of said first blade (110) and a third linear blade (111) perpendicular to the longitudinal axis of the first blade (110).

17 Claims, 2 Drawing Sheets

EASY OPENING OF FILM WRAPPER

This application is a national stage application under 35 USC §371 of International Application Number PCT/EP2005/056231, filed Nov. 25, 2005, the international Application being published in English. This application also claims priority under 35 USC §119 to European Application No. 04028708.8, filed Dec. 3, 2004.

FIELD OF THE INVENTION

This invention relates to a packaged article comprising an improved film wrapper comprising means to facilitate opening and removal of said film wrapper. The present invention also relates to a knife and a process for applying such means to a film wrapper, and to the film wrapper itself.

BACKGROUND

Packaged articles are often provided with a thin film wrapper. The wrapper may be provided with a tear tape. Such tape helps the consumer to open the wrapper by pulling on the tear tape. Typically, such wrapper additionally comprises a tab (pull tab) at one end of the tear tape to facilitate identification and grasping of the tear tape. Examples of packaged articles provided with a film wrapper comprising a tear tape include cigarette cartons, compact disc and DVD cases, video and audio cassette boxes and food and beverage containers.

For example, cigarette cartons, also referred to as bundles, are typically over wrapped with a heat-shrinkable polyolefin film provided with a tear tape and a pull tab. Such cartons contain several packs of cigarettes, for example ten packs arranged in two superimposed rows of five packs each. In use, the over wrapper is separated into at least two pieces along the line of the tear tape by the consumer's grasping on a pull tab, which is provided in the film in line with the tear tape, and pulling along the line of the tear tape. Usually, the tear tape is not located in the center of the film wrapper but rather divides the film wrapper into two pieces of different size. These two pieces should be completely removed to enable access to the contents of the carton. However, the more tightly the film is wrapped around the carton, the more difficult it is to remove all of the over wrapper. In particular, the larger piece of the film wrapper is difficult to remove. Thus the consumer often struggles to remove the wrapper and may find it necessary to use an additional instrument, such as a knife, a pair of scissors, or other sharp instrument, to remove all parts of the film wrapper. This is inconvenient not least because the consumer may not have a suitable additional instrument readily at hand. Furthermore, use of such instrument involves the risk of damaging the article.

SUMMARY OF THE INVENTION

Accordingly, it is an object of the present invention to provide a packaged article 200 (FIG. 3) with an improved film wrapper comprising a tear tape which wrapper includes means to facilitate easy opening and removal of said wrapper by hand. Such means substantially eliminate the need for use of an additional instrument to remove the wrapper.

It is another object of the present invention to provide an improved film wrapper comprising a tear tape.

The improved film wrapper of the invention comprises a tear tape, wherein at least one pre-defined perpendicular weakening line in close proximity to said tear tape is present in said film wrapper. The longitudinal axis of such perpendicular weakening line is substantially perpendicular to the tear tape. The number of perpendicular weakening lines may be chosen depending on the dimensions of the article. As used herein, 'at least one pre-defined perpendicular weakening line' means one or more such lines, preferably one, two, or three perpendicular weakening lines. Advantageously, the number of lines is kept to a minimum. A perpendicular weakening line forms a predetermined trigger or starting point for the formation of tears in the film wrapper upon opening and removal thereof. Preferably, the film wrapper is asymmetrically divided by the tear tape, and the at least one perpendicular weakening line is located in the larger section of the film wrapper. It has surprisingly been found that the presence of the at least one perpendicular weakening line does not decrease the stability of the film wrapper of the present invention before opening.

In a preferred embodiment of the present invention, the film wrapper also includes a weakening line parallel to the tear tape (so-called parallel weakening line) in addition to the at least one perpendicular weakening line. Such parallel weakening line has a longitudinal axis which is substantially parallel to the tear tape. The parallel weakening line is located in close proximity to the tear tape. During the tear tape pulling process, this parallel weakening line can direct the movement of the tear tape into one specific direction, thus enabling a site-directed disruption of the respective portion of the film wrapper.

It is preferred that the at least one perpendicular weakening line and the parallel weakening line are located on different sides of the tear tape. Preferably, the at least one perpendicular weakening line is located in the larger portion of the film wrapper, and the parallel weakening line is located in the smaller portion of the film wrapper, thus directing the movement of the tear tape into the larger portion of the film wrapper and facilitating formation of disruptions therein.

Preferred is a film wrapper comprising two or three perpendicular weakening lines, in particular if an additional parallel weakening line is present.

For embodiments with two or more perpendicular weakening lines these may be distributed along the length of the tear tape, or alternatively they may be grouped closely together. Preferably, all perpendicular weakening lines are located on the same side of the tear tape. In particular, for a film wrapper which is divided by the tear tape into two portions of different size, all the perpendicular weakening lines are preferably located in the larger portion of the film wrapper to facilitate removal of this portion.

Preferably, the parallel weakening line is located adjacent to the end or at the end of the tear tape, in particular adjacent to or at that end without the pull tab. This arrangement facilitates formation of disruptions in the opposite section of the film wrapper, (just) before completion of the tear tape pulling process.

In another embodiment of the present invention, at is least one perpendicular weakening line is present on either side of the tear tape. This embodiment is particularly advantageous where the film wrapper is divided by the tear tape into two sections of essentially the same size. As a consequence of the presence of at least one perpendicular weakening line in either section of the film wrapper, both sections are equipped with trigger points allowing the consumer to easily remove either section of the film wrapper.

Where the film wrapper of the invention includes a parallel weakening line in addition to the at least one perpendicular weakening line, the length of said parallel weakening line preferably exceeds the length of said at least one perpendicular weakening line. In case of two or more perpendicular weakening lines these may differ in length. Alternatively, the length of all weakening lines may be the same.

The length of the perpendicular and parallel weakening lines in a film wrapper of the present invention is predetermined and preferably between about 1 mm and about 10 mm, more preferably between about 1 mm and about 8 mm, most preferably between about 1 mm and about 6 mm. If desired and depending on the specific application of the film wrapper, the weakening lines may be made small enough to be hardly visible for the consumer. However, in some applications it may be desirable that one or more weakening lines are longer and noticeable, optionally marked, for example, by colour, to draw the consumer's attention to them.

In the context of the present invention, a perpendicular or parallel weakening line preferably is a substantially linear distinctive cut which extends through the entire thickness of the film wrapper. Such a cut may be made by means of a sharp tool, such as a knife having a blade corresponding to the desired shape of the cut, preferably a linear blade. A weakening line may also be produced by means of a laser, or any other suitable perforation tool. In such case, the obtained weakening line is a perforated line rather than a distinctive cut. It is also possible to create a weakening line by embossing. As mentioned above, a weakening line is preferably linear. However, various shapes are possible, for example curved or branched, tree-like shapes. Such shapes can easily be made by perforation. Advantageously, all weakening lines in a wrapper of the invention are produced using the same technology.

In a preferred embodiment of the present invention, the film wrapper further comprises a pull tab located at one end of the tear tape. The pull tab may be a longitudinal extension of the tear tape, and may as such consist of the same material as the tear tape. Typically, the pull tab is created during production of the film wrapper, for example, by means of a U-shaped knife. As a result, a cut-out corresponding to the shape of said pull tab may be located at the other end of the tear tape. To open the film wrapper the consumer grasps the pull tab and pulls in the longitudinal direction of the tear tape, that is along the direction of the tear tape. The tear tape may be embedded in the film wrapper or may be affixed to the surface thereof using suitable means and methods well known in the art. Suitable means include, for example, a hot melt wax composition, a pressure sensitive adhesive or any other suitable adhesive.

A weakening line is located in close proximity to the tear tape. Advantageously, the distance between the tear tape and the parallel weakening line is less than about 10 mm and the distance between the tear tape and the nearest end of the at least one perpendicular weakening line is less than about 10 mm. Preferably, a weakening line is directly adjacent to the tear tape. The at least one perpendicular weakening line is preferably located such that one end thereof is substantially or almost in contact with the tear tape and, where included, the parallel weakening line is preferably located directly adjacent to one edge, preferably the edge remote from the perpendicular weakening line, with very little, if any space in between the line and the tape.

It is preferred that the pre-determined weakening lines of a wrapper of the invention and the cut-out for the pull tab are produced with the same tool. A suitable tool, for example, comprises a first instrument, such as a U-shaped blade, with which the pull tab and the cut-out are made, and two additional instruments, for example linear blades, one of which cuts the perpendicular weakening line and the other one cutting the parallel weakening line. For a film wrapper of the invention comprising a pull tab and a corresponding cut-out it is preferred that the at least one weakening line is located close to the cut-out. It is particularly advantageous that the parallel weakening line is as close as possible to the end of the tear tape at which the cut-out is located.

The film wrapper of the present invention may be made of any suitable thermoplastic packaging material, for example a polyolefin or any other suitable polymer, including but not limited to polyethylene, polypropylene or copolymers thereof. Preferred is a heat-shrinkable film wrapper or a shrink film wrapper.

The film wrapper of the present invention may be transparent or coloured, printed or otherwise decorated.

Furthermore, the present invention provides a packaged article with a film wrapper according to the present invention. Preferred are packaged articles comprising a film wrapper indicated as being preferred. For example, the film wrapper of the present invention may be used as over wrapper for a cigarette pack or for a container comprising a plurality of individual items. In particular, the present invention provides cigarette cartons comprising a film over wrapper of the present invention. Such cigarette cartons are commercially available and contain a plurality of cigarette packs, preferably at least two superimposed rows of 3 to 10 packs each, more preferably of 4 to 7 cigarette packs each. The cartons can be made of paper, cardboard, plastic materials, metals, or any combination thereof. The carton and/or the wrapper may be printed or otherwise decorated, for example with a label, logo, writing, embossing, and any combination thereof.

The film wrapper of the present invention is useful to envelop any desired article or plurality of articles, for example an article in need for protective wrapping. Examples of packaged articles according to the present invention include compact disc cases, DVD cases, and video or audio tape cases, food and beverage containers, bundles of paper products and labels, envelopes and pads of notepaper. The packaged article may consist of a number of individual similar or dissimilar items which are wrapped together to form a 'multi-pack'. Use of the film wrapper of the present invention is advantageous where the article to be wrapped has six flat surfaces including at least two major surfaces, such as a cigarette carton. Use of the film wrapper of the present invention is particularly advantageous where the film wrapper is wrapped tightly around the article.

As described above, to enable a consumer to open the film wrapper of the present invention, a pull tab is provided at one end of the tear tape. This pull tab can be created during production of the film wrapper by means of a knife having a blade with the desired shape. Preferably, this blade is U-shaped, which will create a U-shaped pull tab during the production process for one sheet of film, and at the same time a U-shaped cut-out for the next sheet of film. Different shapes are also possible, such as triangles, quadrangles, or squares. Triangles result in V-shaped cut-outs and pull tabs. The shape of the pull tab should allow it to be conveniently gripped by the consumer.

During production of the film wrapper of the present invention, a multi-bladed knife can be used to produce the cut-out, the pull tab and the linear cuts. Such a knife preferably comprises a U-shaped or V-shaped first blade, a second linear blade parallel to the longitudinal axis of the first blade and a third linear blade perpendicular to the longitudinal axis of said first blade.

Additional perpendicular linear cuts in the film wrapper may be produced by means of additional conventional knives having a single linear blade. To provide different cuts at the desired locations in the film wrapper, different knives are preferably positioned around a cylindrically-shaped cutting head in a conventional over wrapping machine. Preferably, the cutting head comprises one multi-bladed knife according to the present invention (having a U-shaped or V-shaped blade, one additional perpendicular blade and one additional parallel blade) and two conventional single-bladed knives so that in total one parallel cut and three perpendicular cuts are made in each individual sheet of film wrapper.

The cutting tool of the present invention is useful for providing a U- or V-shaped cut-out in an over wrapping film for display cartons comprising a tear tape, said cut-out matching said tear tape, and simultaneously providing a cut parallel to said tear tape located on one side of said tear tape, and simultaneously providing a cut perpendicular to said tear tape located on the other side of said tear tape.

The invention further comprises a cutting head comprising the multi-bladed knife of the present invention.

The invention further comprises a process for the manufacture of a film wrapper comprising a tear tape in which at least one weakening line is placed in the film wrapper next to the tear tape, wherein the at least one weakening line is to the tear tape.

A typical process to produce an article, such as a cigarette carton or cigarette pack, wrapped in the film wrapper of the present invention comprises: continuously unwinding a heat-shrinkable film from a supply reel, applying a tear tape to said film, cutting said film into individual pieces of the desired size (substantially matching the size of the article to be wrapped) perpendicular to the unwinding direction of the film by a main knife, making a cut-out to a first of said cut pieces, at the same time cutting a pull tab to an adjacent second piece, and again at the same time making a horizontal and a perpendicular cut to said second piece using the multi-bladed knife of the present invention, thereafter placing the article to be wrapped on said second cut piece, wrapping said second cut piece around said article, and finally heat-shrinking said film wrapper around said article, for example, in a heat tunnel.

BRIEF DESCRIPTION OF THE DRAWINGS

The present invention will be illustrated, by way of example only, with reference to the appended figures. These figures should not be construed to limit the present invention.

It is shown in

DETAILED DESCRIPTION OF THE INVENTION

Figure 1:
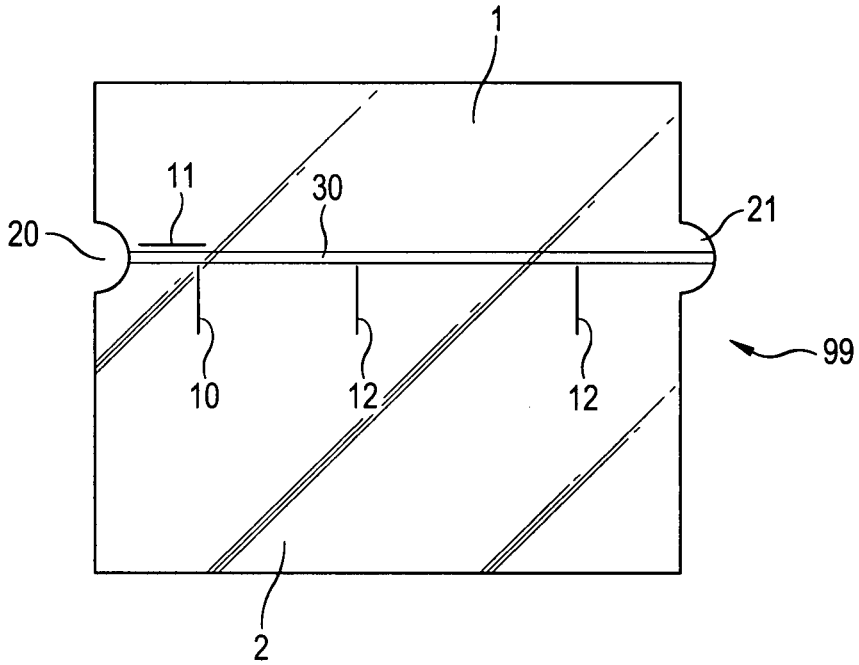
FIG. 1: a film wrapper according to the present invention.

FIG. 1 shows a film wrapper 99 with a first (top) portion 1, a second (bottom) portion 2, and a tear tape 30 extending between the U-shaped cut-out 20 and the U-shaped pull tab 21. Close to the U-shaped cut-out 20 are a parallel cut 11 and a perpendicular cut 10. Also shown are two additional perpendicular cuts 12. To open a carton wrapped with film wrapper 99, the consumer first tears the film wrapper 99 into two pieces 1 and 2 by pulling on pull tab 21 of tear tape 30 in the direction of cut-out 20. After that pulling process, the top portion 1 of the film wrapper 99 is separated from the bottom portion 2, and the tear tape 30. To remove portion 2 of the film wrapper 99, the consumer manually tears portion 2 from the display carton, which is significantly facilitated by the three perpendicular cuts 10 and 12. Top portion 1 is smaller than bottom portion 2 and can easily be removed.

Figure 2:
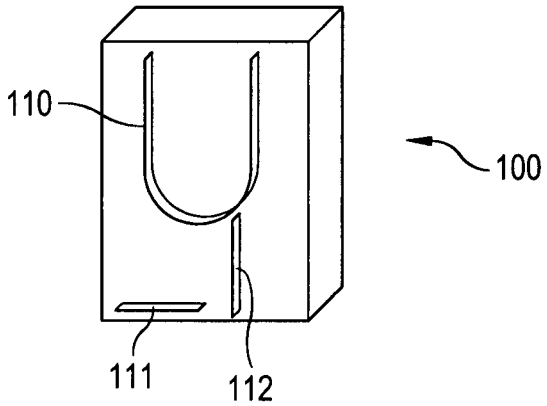
FIG. 2: a multi-bladed knife according to the present invention.
Figure 3:
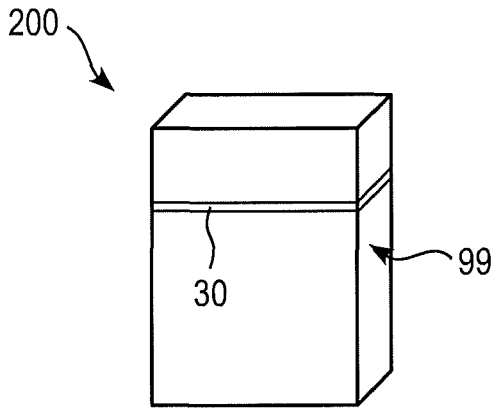
FIG. 3: a packaged article and/or packaged cigarette carton or cigarette pack.
Figure 4:
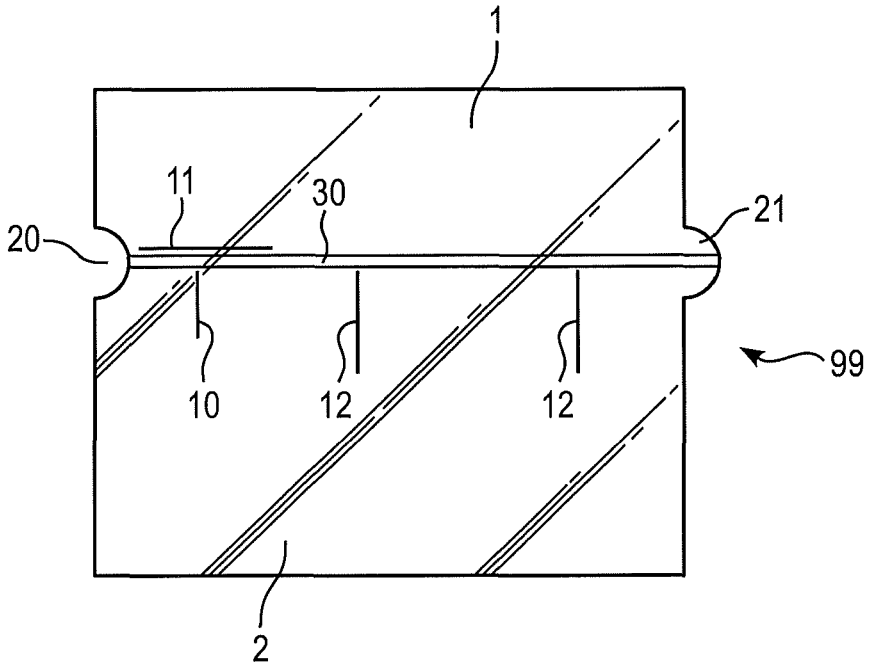
FIG. 4: a film wrapper showing the length of the parallel weakening line exceeding the length of at least one perpendicular weakening line and the lengths of two or more perpendicular lines being different.

FIG. 2 shows the knife 100 which can be used in a cutting head in a conventional over wrapping machine (not shown) with the U-shaped blade 110 to produce cut-out 20 and pull tab 21 as shown in FIG. 1, blade 112 being parallel to the longitudinal axis of the U-shaped blade 110, and blade 111 being perpendicular to the longitudinal axis of the U-shaped blade 110. Due to the positioning of blades 112 and 111 to the right and left of the apex of the U-shaped blade 110, respectively, cuts 11 and 10 produced by these blades are formed on different sides of tear tape 30.

The invention claimed is:

1. A film wrapper comprising:

a tear tape having a pull tab, which is a longitudinal extension of the tear tape;

at least one perpendicular weakening line next to and neither in contact with the tear tape nor a weakening line, the longitudinal axis of the at least one perpendicular weakening line being substantially perpendicular to the tear tape; and a single parallel weakening line next to and neither in contact with the tear tape nor another weakening line, the longitudinal axis of the parallel weakening line being substantially parallel to the tear tape, and wherein the at least one perpendicular weakening line and the single parallel weakening line are located on opposite sides of the tear tape, and wherein the single parallel weakening line is located adjacent to an end of the tear tape without the pull tab.

2. The film wrapper according to claim 1, wherein the at least one perpendicular weakening line is two or three perpendicular weakening lines.

3. A film wrapper according to claim 1 wherein the film wrapper is used for wrapping an article.

4. The film wrapper according to claim 1, wherein the tear tape separates the film wrapper into a first portion and a second portion, and wherein the first portion is smaller than the second portion.

5. The film wrapper according to claim 4, wherein the at least one perpendicular weakening line is located in the second portion of the film wrapper, and the single parallel weakening line is located in the first portion of the film wrapper.

6. The film wrapper according to claim 1, wherein a length of the single parallel weakening line exceeds a length of the at least one perpendicular weakening line.

7. The film wrapper according to claim 1, wherein the pull tab is a U-shaped pull tab, and the tear tape extends between a U-shaped cut-out and the U-shaped pull tab.

8. The film wrapper of claim 1, wherein the at least one perpendicular weakening line and/or the single parallel weakening line are colored to draw a consumer's attention to the weakening line.

9. A packaged article, the package article comprising:

a cigarette carton or a cigarette pack; and a film wrapper, the film wrapper comprising:

a tear tape having a pull tab, which is a longitudinal extension of the tear tape;

at least one perpendicular weakening line next to and neither in contact with the tear tape nor a weakening line, the longitudinal axis of the at least one perpendicular weakening line being substantially perpendicular to the tear tape; and a single parallel weakening line next to and neither in contact with the tear tape nor another weakening line, the longitudinal axis of the parallel weakening line being substantially parallel to the tear tape, and wherein the at least one perpendicular weakening line and the single parallel weakening line are located on opposite sides of the tear tape, and wherein the single parallel weakening line is located adjacent to an end of the tear tape without the pull tab.

10. The packaged article according to claim 9, wherein the tear tape separates the film wrapper into a first portion and a second portion, and wherein the first portion is smaller than the second portion, and the at least one perpendicular weakening line is located in the second portion of the film wrapper, and the single parallel weakening line is located in the first portion of the film wrapper.

11. The packaged article according to claim 9, wherein a length of the single parallel weakening line exceeds a length of the at least one perpendicular weakening line.

12. The packaged article according to claim 9, further comprising two or more perpendicular weakening lines, which are distributed along a length of the tear tape.

13. The packaged article according to claim 9, wherein the pull tab is a U-shaped pull tab, and the tear tape extends between a U-shaped cut-out and the U-shaped pull tab.

14. A film wrapper comprising:

a tear tape having a pull tab, which is a longitudinal extension of the tear tape;

two or more perpendicular weakening lines next to and neither in contact with the tear tape nor a weakening line, and which are distributed along a length of the tear tape, the longitudinal axis of the two or more perpendicular weakening lines being substantially perpendicular to the tear tape and wherein the two or more perpendicular weakening lines; and a single parallel weakening line are located on opposite sides of the tear tape, and wherein the single parallel weakening line is next to and neither in contact with the tear tape nor another weakening line, and wherein the single parallel weakening line is located adjacent to an end of the tear tape without the pull tab.

15. The film wrapper of claim 14, wherein the longitudinal axis of the single parallel weakening line is substantially parallel to the tear tape.

16. The film wrapper of claim 14, wherein lengths of the two or more perpendicular weakening lines are different.

17. The film wrapper according to claim 14, wherein the pull tab is a U-shaped pull tab, and the tear tape extends between a U-shaped cut-out and the U-shaped pull tab.

* * * * *